United States Patent [19]

Riehl

[11] 4,433,266

[45] Feb. 21, 1984

[54] ELECTRICAL IGNITION PROBE MEANS AND METHOD OF MAKING THE SAME

[75] Inventor: Fred Riehl, Greensburg, Pa.

[73] Assignee: Robert Shaw Controls Company, Richmond, Va.

[21] Appl. No.: 241,003

[22] Filed: Mar. 6, 1981

[51] Int. Cl.[3] ..... H01T 13/04; F23Q 3/00; F23Q 3/70

[52] U.S. Cl. ..... 313/135; 431/264; 445/7; 361/253

[58] Field of Search ..... 313/135; 431/464, 466; 361/253; 445/7; 339/252 R

[56] References Cited

U.S. PATENT DOCUMENTS

| | | | |
|---|---|---|---|
| 1,352,033 | 9/1920 | Sherman et al. | 313/135 X |
| 2,545,945 | 3/1951 | Ensign et al. | 431/266 |
| 2,715,200 | 8/1955 | Flynn | 361/253 |
| 3,073,121 | 1/1963 | Baker et al. | 431/266 X |
| 3,505,568 | 4/1970 | Flynn | 361/253 |
| 4,136,259 | 1/1979 | Djeddah | 445/7 X |
| 4,298,336 | 11/1981 | Riehl | 431/264 |

OTHER PUBLICATIONS

Admitted Prior Art Electrical Ignition Probe Means.

*Primary Examiner*—Palmer C. Demeo
*Assistant Examiner*—Sandra L. O'Shea
*Attorney, Agent, or Firm*—Candor, Candor & Tassone

[57] ABSTRACT

An electrical ignition probe having an electrode wire provided with a sparking end and an opposed end spliced to an end of an ignition wire that has electrical insulation thereon and disposed inboard of the end of the ignition wire, the probe having a rigid electrically insulating body provided with opposed ends and telescoped on the electrode wire in such a manner that the opposed ends of the body are respectively disposed inboard of the ends of the electrode wire, and an electrically insulating unit overlapping adjacent parts of the body and the electrical insulation on the ignition wire to electrically insulate the spliced ends of the electrode wire and the ignition wire. The insulating unit comprises a rigid electrically insulating tubular member having opposed ends and an opening passing through the opposed ends thereof and telescopically receiving the spliced ends and the adjacent parts of the electrode wire and the ignition wire therein.

20 Claims, 6 Drawing Figures

ELECTRICAL IGNITION PROBE MEANS AND METHOD OF MAKING THE SAME

BACKGROUND OF THE INVENTION

1. Field of the Invention

This invention relates to an improved electrical ignition probe means for a pilot burner of a fuel burning apparatus, such as a cooking apparatus or the like, and to the methods of making such an electrical ignition probe means.

2. Prior Art Statement

It is known to provide an electrical ignition probe means having an electrode wire provided with a sparking end and an opposed end spliced to an end of an ignition wire that has electrical insulation thereon and disposed inboard of the end of the ignition wire, the probe means having a rigid electrically insulating body provided with opposed ends and telescoped on the electrode wire in such a manner that the opposed ends of the body are respectively disposed inboard of the ends of the electrode wire and electrically insulating means overlapping adjacent parts of the body and the electrical insulation on the ignition wire to electrically insulate the spliced ends of the electrode wire and the ignition wire. The insulating means comprises a flexible plastic tubing that has been heat-shrunk over the spliced ends of the electrode wire and the ignition wire, as well as the adjacent parts of the ignition wire and the insulating body, after the spliced ends have been crimped together by a metallic band disposed around the same.

For example see the copending patent application, Ser. No. 073,673, filed Sept. 10, 1979 now U.S. Pat. No. 4,298,336 wherein such prior known arrangement is generally disclosed.

SUMMARY OF THE INVENTION

It is a feature of this invention to provide an improved electrical ignition probe means for a pilot burner means of a fuel burning apparatus and to a method of making such an electrical ignition probe means.

In particular, it was found according to the teachings of this invention that the prior known structure and method for splicing an electrode wire to an ignition wire for an electrical ignition probe means required an expensive flexible plastic sleeve and method of heat shrinking the same in place over adjacent parts of the ceramic probe body and the insulating material of the ignition wire in order to electrically insulate the spliced ends.

However, it was found according to the teachings of this invention that the expensive flexible plastic shrink tube and the associated processing equipment and procedure therefor can be eliminated if a rigid electrically insulating tubular member of this invention is utilized.

For example, one embodiment of this invention provides an electrical ignition probe means having an electrode wire provided with a sparking end and an opposed end spliced to an end of an ignition wire that has electrical insulation thereon and disposed inboard of the end of the ignition wire, the probe means having a rigid electrically insulating body provided with opposed ends and telescoped on the electrode wire in such a manner that the opposed ends of the body are respectively disposed inboard of the ends of the electrode wire and electrically insulating means overlapping adjacent parts of the body and the electrical insulation on the ignition wire to electrically insulate the spliced ends of the electrode wire and the ignition wire. The insulating means comprises a rigid electrically insulating tubular member having opposed ends and an opening means passing through the opposed ends thereof and telescopically receiving the spliced ends and the adjacent parts of the electrode wire and the ignition wire therein.

Accordingly, it is an object of this invention to provide an improved electrical ignition probe means having one or more of the novel features of this invention as set forth above or hereinafter shown or described.

Another object of this invention is to provide a method of making such an electrical ignition probe means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 1 is a fragmentary side view of the improved electrical ignition probe means of this invention mounted to a pilot burner means of a fuel burning apparatus or the like.

DESCRIPTION OF THE PREFERRED EMBODIMENT

Figure 1:
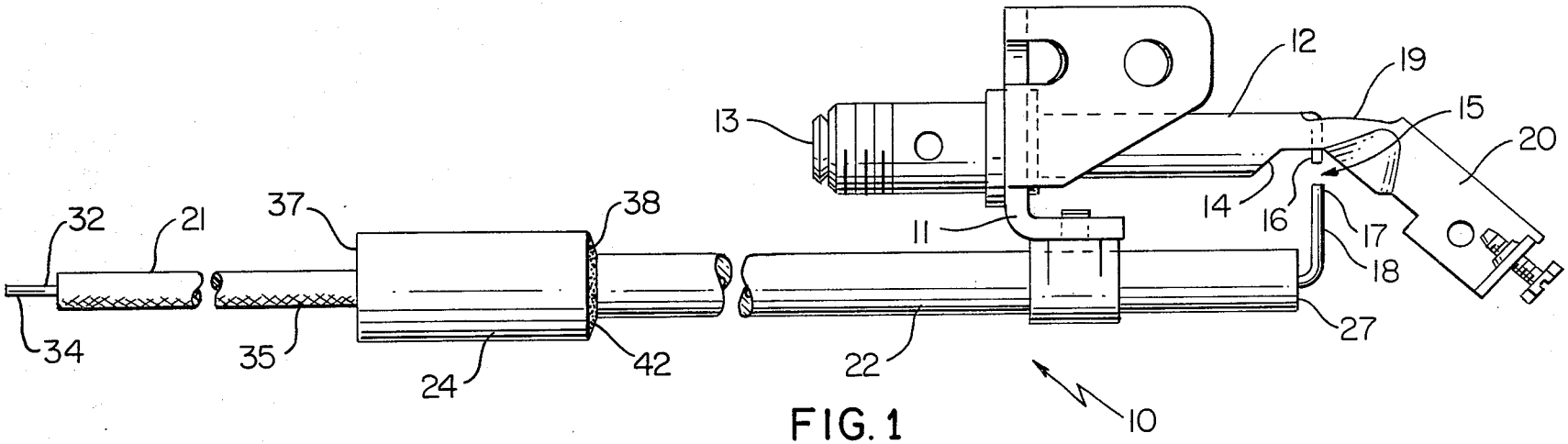

Referring now to FIG. 1, the improved electrical ignition probe means of this invention is generally indicated by the reference numeral 10 and is illustrated as being secured by suitable bracket means 11 to a pilot burner means 12 in the manner fully set forth in the afore-mentioned copending patent application, Ser. No. 073,673, whereby only the details of the pilot burner means 12 necessary to understand this invention need be set forth as the features of this invention are directed to the electrical ignition probe means 10 and not to the particular pilot burner means utilized therewith.

The pilot burner means 12 illustrated in FIG. 1 has an inlet 13 adapted to be interconnected to a source of fuel and has an outlet 14 through which the fuel issues and passes through a spark gap 15 defined between a diffusion tang 16 of the pilot burner means 12 and an end 17 of an electrode wire 18 of the electrical ignition probe means 10 of this invention whereby electrical sparking is adapted to occur between the probe end 17 and the difusion tang 16 of the grounded pilot burner means 12 to ignite the fuel issuing out of the outlet 14 of the pilot burner means 12 whereby the resulting pilot flame can pass out through an opening 19 in a flame shield 20 of the pilot burner means 12 in a manner well known in the art to provide a standing pilot flame.

Once a sufficient flame exists at the outlet 14 of the pilot burner means 12, the flame ionizes the gas in the spark gap 15 so that sparking between the probe end 17 and the diffusion tang 16 will cease to exist because the ionization of the gas between the probe end 17 and the diffusion tang 16 continuously dissipates a capacitor which originally had the charge build up to cause the sparking from the probe end 17 so that further sparking of the electrical ignition probe means 10 does not take place as long as the pilot flame exists at the pilot burner 12.

However, should the flame cease, the capacitor of the electrical circuit (not shown) is then permitted to build up its charge in a manner well known in the art to cause a re-sparking from the end 17 of the probe means 10 to the grounded diffusion tang 16 of the pilot burner means 12 to re-ignite the issuing fuel.

Figure 2:
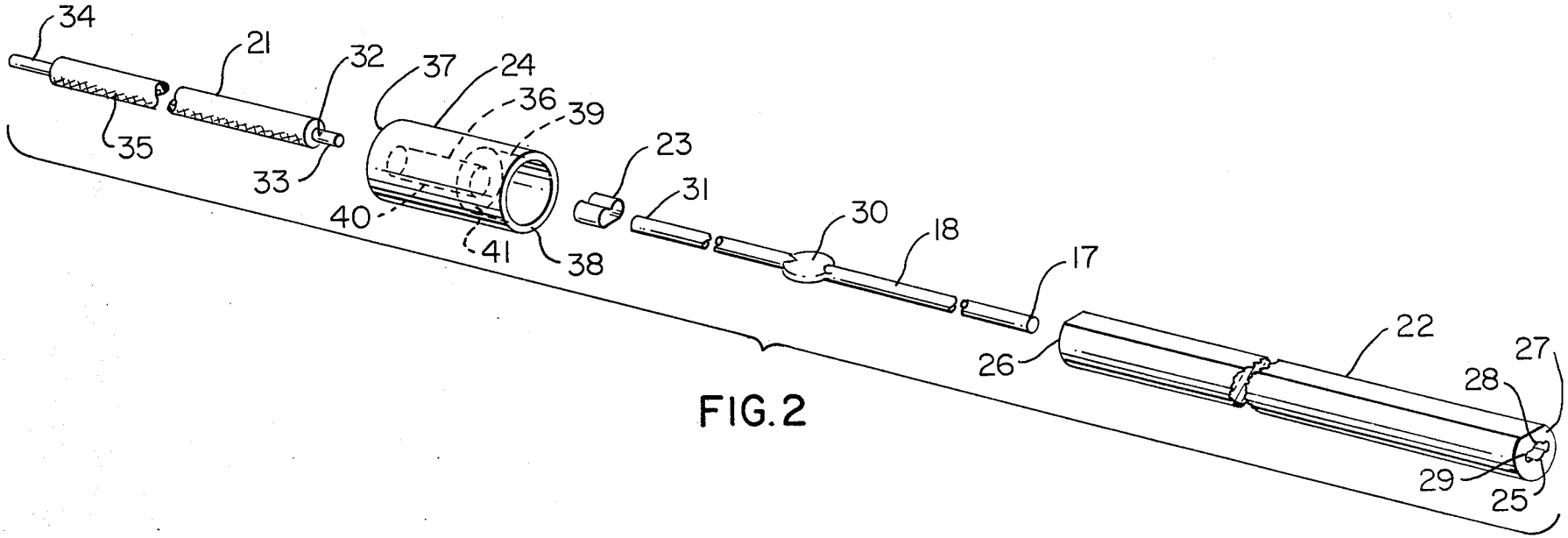
FIG. 2 is an exploded perspective view illustrating the various parts of the electrical ignition probe means of FIG. 1.

The details of the electrical ignition probe means 10 of this invention and the method of this invention for making such electrical ignition probe means 10 will now be described and reference is made to FIG. 2 wherein it can be seen that the electrical ignition probe means 10 of this invention is formed from the electrode wire 18, an ignition wire 21 a rigid electrically insulating body 22, a metallic splicing clip means 23 and a unique rigid electrically insulating tubular member 24 of this invention.

The electrically insulating body 22 can be formed of ceramic material and has an opening 25 passing through the opposed ends 26 and 27 thereof, the opening 25 having a circular cross-sectional portion 28 intersecting with a substantially rectangular cross-sectional portion 29 so as to accommodate a flattened portion 30 of the electrode wire 18 that is formed intermediate the ends 17 and 31 thereof. In this manner, when the electrode wire 18 is disposed into the opening means 25 of the ceramic body 22, the flat portion 30 thereof interlocks into the rectangular part 29 of the opening 25 so as to prevent rotational movement of the electrode wire 18 relative to the body 22 once the body 22 has been telescoped on the electrode wire 18 in the manner illustrated in FIG. 3.

While the electrode wire 18 can comprise any suitable conductive material, it has been found that the same can be formed from stainless steel wire and be approximately 0.062 of an inch in diameter while being approximately 3.765 of an inch in length.

The ignition wire 21 comprises a conductive wire 32 having its opposed ends 33 and 34 bared and exposed from the electrical insulating means 35 carried thereon whereby the end 34 of the ignition wire 21 is adapted to be interconnected to a suitable terminal means to be subsequently interconnected into the electrical circuit for the electrical ignition means for the pilot burner means 12, the end 33 of the ignition wire 21 to be spliced to the end 31 of the electrode wire 18 in a manner hereinafter set forth.

While the ignition wire 21 can comprise any suitable ignition wire means, it has been found that the same can comprise size number 18 tinned copper wire coated with a silicone rubber and covered with a fray resistant glass braided jacket, the length of the ignition wire 21 being any desired length within suitable limits.

The rigid electrically insulating tubular member or probe coupling 24 of this invention is formed of ceramic material in substantially cylindrical form and has a stepped opening means 36 passing centrally through the opposed ends 37 and 38 thereof, the opening 36 having two coaxially aligned bore parts 39 and 40 that are of different diameters and thereby define and are joined together at an annular shoulder 41 located internally in the tubular member 24 for a purpose hereinafter described.

Figure 3:
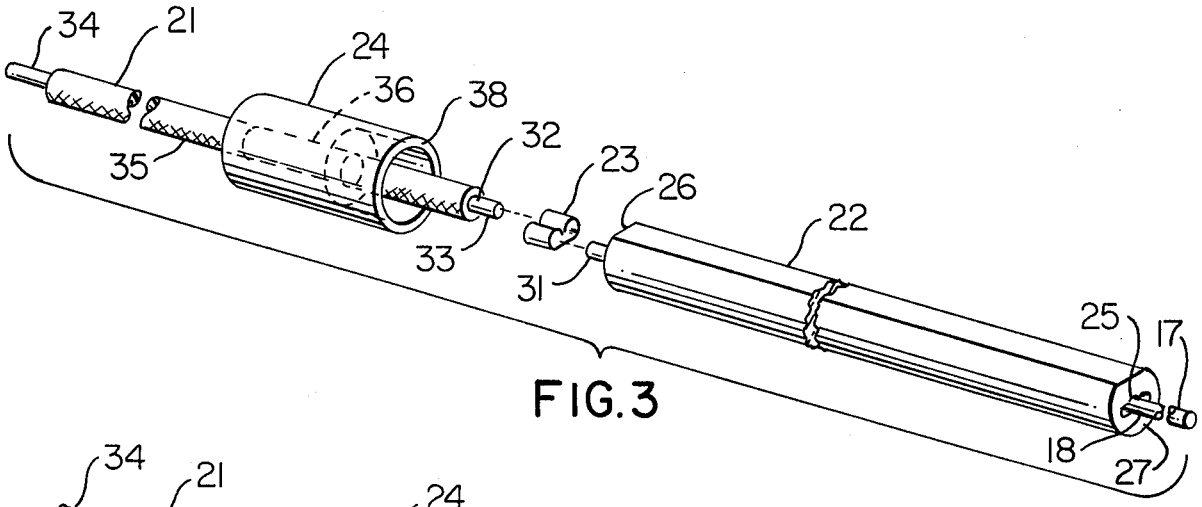
FIG. 3 is a view similar to FIG. 1 and illustrates one of the steps in the method of this invention for making the electrical ignition probe means of FIG. 1.

The tubular member 24 can be first telescoped onto the ignition wire 21 in the manner illustrated in FIG. 3 so that the end 33 of the ignition wire 21 is exposed from the end 38 of the tubular member 24 or the tubular member 24 can be telescoped onto the ignition wire 21 after the ignition wire 21 has been spliced to the electrode wire 18, as desired.

In any event, the end 31 of electrode wire 18 is brought into a side-by-side relation with the end 33 of the ignition wire 21 and a metallic clip 23 is disposed about the same and is clipped thereto in a manner well known in the art of splicing adjacent ends of wires mechanically together as illustrated, the clip 23 being formed of any suitable material such as stainless steel.

During such splicing operation with the metallic clip 23, the insulated body 22 can be disposed on the electrode 18 before or after the clip 23 has been utilized to splice the ends 33 and 31 together, as desired.

Figure 4:
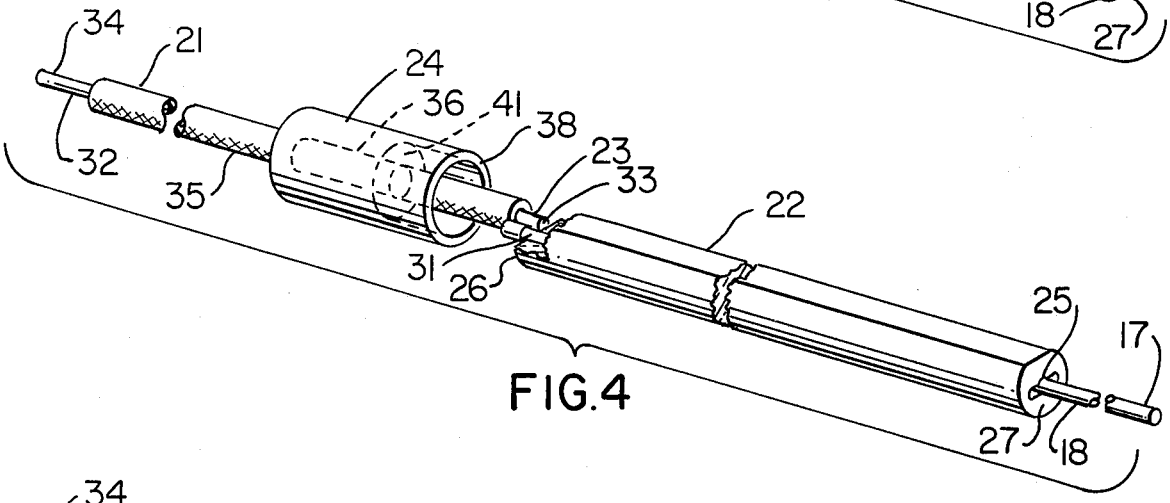
FIG. 4 is a view similar to FIG. 3 and illustrates another step in the method of this invention.
Figure 5:
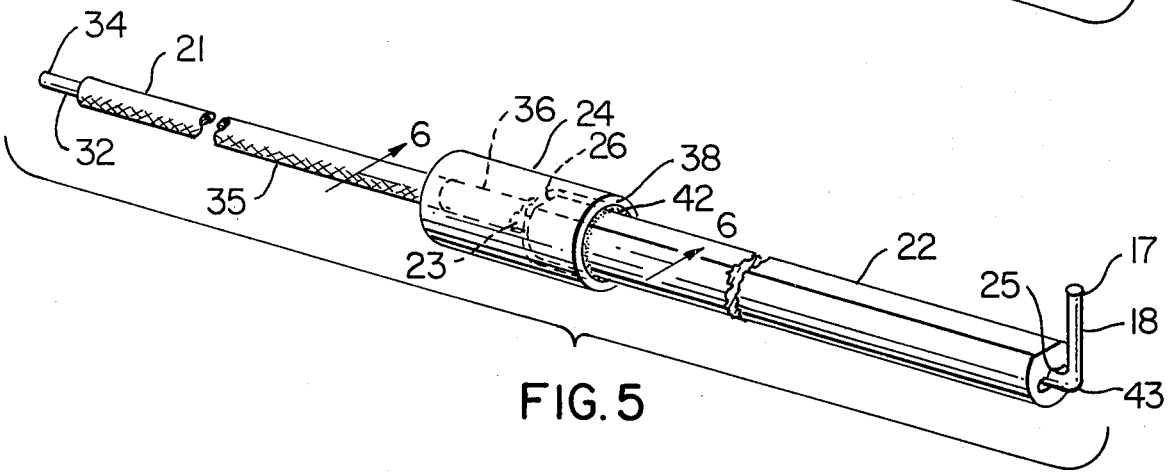
FIG. 5 is a perspective view of the completed electrical ignition probe means of this invention.

In any event, after the ends 31 and 33 have been spliced together by the clip 23, the insulating body 22 is telescoped on the electrode wire 18 in a manner to have its end 26 positioned against the clip 23 as illustrated in FIG. 4 so that the outer end 17 can be bent at the right angle 43 illustrated in FIG. 5 adjacent the end 27 of the insulating body 22 to hold the insulating body 22 from movement between the clip 23 and the bent end 17 of the electrode wire 18, the end 17 of the bent electrode wire 18 then being suitably trimmed to provide for the proper length for the spark gap 15 for the purpose previously described.

Figure 6:
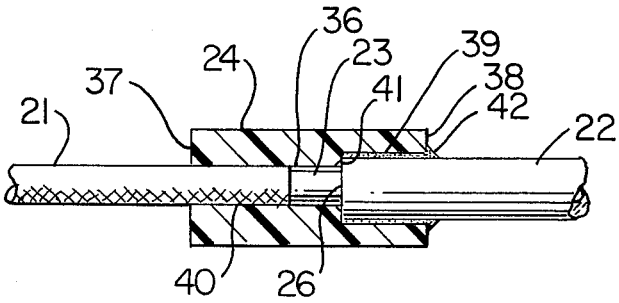
FIG. 6 is a fragmentary cross-sectional view taken on line 6—6 of FIG. 5.

Thereafter, the electrically insulating tubular member 24 is telescoped onto the ignition wire 21, if the same has not been previously telescoped thereon, and is moved to the right to telescope over the end 26 of the insulating body 22 to have its annular shoulder 41 abut against the end 26 of the insulating body 22 in the manner illustrated in FIG. 6 as the clip 23 is received in the bore portion 40 of the insulating tubular member 24 to permit such telescoping relation. Thereafter, a suitable adhesive means 42 is disposed on the annular shoulder 38 of the insulating tubular member 24 and onto the insulating body 22 in a manner illustrated in FIGS. 1 and 6 so that when the adhesive means 42 is subsequently cured and set, the adhesive means 42 firmly bonds the ceramic members 24 and 22 together so that the spliced ends 31 and 33 of electrode wire 18 and the ignition wire 21 are fully insulated by the secured together insulating members 22 and 24 in the manner illustrated in FIG. 6.

Therefore, it can be seen that the ceramic part 22 is firmly secured to the spliced ends 31 and 33 of the electrode wire 18 and the ignition wire 21 by the coupling member 24 so that movement therebetween cannot take place.

After the electrical ignition probe means 10 of this invention has been made in the manner previously described by the method of this invention, the completed electrical ignition probe means 10 is adapted to be secured to a pilot burner 22 by the bracket means 11 fastening around the ceramic body 22 so that the end 17 of the electrode wire 18 is properly positioned vertically beneath the diffusion tang 16 of the pilot burner means 12 to create the spark gap 15 therewith and operate in a manner previously described.

However, it is to be understood that the ignition probe means 10 of this invention can be utilized for sparking with other devices than just the pilot burner means 12. For example, the ignition probe means 10 can be utilized for directly sparking with the main burner means for direct ignition thereof, if desired.

Therefore, it can be seen that this invention not only provides an improved electrical ignition probe means, but also this invention provides an improved method of making such an electrical ignition probe means.

While the form and method of this invention now preferred has been illustrated and described as required by the Patent Statute, it is to be understood that other forms and method steps can be utilized and still fall within the scope of the appended claims.

What is claimed is:

1. In an electrical ignition probe means having an electrode wire provided with a sparking end and an opposed end spliced to an end of an ignition wire that has electrical insulation thereon and disposed inboard of said end of said ignition wire, said probe means having a rigid electrically insulating body provided with opposed ends and telescoped on said electrode wire in such a manner that said opposed ends of said body are respectively disposed inboard of said ends of said electrode wire, and electrically insulating means overlapping adjacent parts of said body and said electrical insulation on said ignition wire to electrically insulate the spliced ends of said electrode wire and said ignition wire, the improvement wherein said insulating means comprises a rigid electrically insulating tubular member having opposed ends and an opening means passing through said opposed ends thereof and telescopically receiving said spliced ends and said adjacent parts of said electrode wire and said ignition wire therein.

2. An ignition probe means as set forth in claim 1 wherein said opening means in said tubular member has a step therein intermediate said ends thereof and defining an annular shoulder, said part of said body abutting said shoulder.

3. An ignition probe means as set forth in claim 2 wherein said opening means of said tubular member comprises two coaxial bores joined together at said shoulder.

4. An ignition probe means as set forth in claim 3 wherein said bores have different diameters so that one bore is larger in diameter than the other bore, said one bore receiving said part of said body therein and said other bore receiving said part of said ignition wire therein.

5. An ignition probe means as set forth in claim 4 wherein said spliced ends of said electrode wire and said ignition wire are received in said other bore.

6. An ignition probe means as set forth in claim 5 and including adhesive means disposed on one of said ends of said tubular member and on an adjacent part of said body to secure said tubular member and said body together.

7. An ignition probe means as set forth in claim 6 wherein said body and said tubular member comprise ceramic material.

8. An ignition probe means as set forth in claim 5 and including a metallic band crimped around said spliced ends of said ignition wire and said electrode wire to secure said spliced ends together.

9. An ignition probe means as set forth in claim 1 wherein said spliced ends of said electrode wire and said ignition wire are disposed in side-by-side relation.

10. An ignition probe means as set forth in claim 9 and including a splicing band means disposed and crimped about said spliced ends of said electrode wire and said ignition wire to secure said spliced ends together.

11. In a method of making an electrical ignition probe means having an electrode wire provided with a sparking end and an opposed end spliced to an end of an ignition wire that has electrical insulation thereon and disposed inboard of said end of said ignition wire, said probe means having a rigid electrically insulating body provided with opposed ends and telescoped on said electrode wire in such a manner that said opposed ends of said body are respectively disposed inboard of said ends of said electrode wire and electrically insulating means overlapping adjacent parts of said body and said electrical insulation on said ignition wire to electrically insulate the spliced ends of said electrode wire and said ignition wire, the improvement comprising the steps of forming said insulating means to comprise a rigid electrically insulating tubular member having opposed ends and an opening means passing through said opposed ends thereof, and telescoping said spliced ends and said adjacent parts of said electrode wire and said ignition wire in said opening means of said tubular member.

12. A method of making an ignition probe means as set forth in claim 11 and including the steps of forming said opening means in said tubular member to define a step therein intermediate said ends thereof and defining an annular shoulder, and abutting said part of said body against said shoulder.

13. A method of making an ignition probe means as set forth in claim 12 and including the step of forming said opening means of said tubular member to comprise two coaxial bores joined together at said shoulder.

14. A method of making an ignition probe means as set forth in claim 13 and including the steps of forming said bores to have different diameters so that one bore is larger in diameter than the other bore, disposing said part of said body in said one bore, and disposing said part of said ignition wire in said other bore.

15. A method of making an ignition probe means as set forth in claim 14 and including the step of disposing said spliced ends of said electrode wire and said ignition wire in said other bore.

16. A method of making an ignition probe means as set forth in claim 15 and including the step of disposing adhesive means on one of said ends of said tubular member and on an adjacent part of said body to secure said tubular member and said body together.

17. A method of making an ignition probe means as set forth in claim 16 and including the step of forming said body and said tubular member from ceramic material.

18. A method of making an ignition probe means as set forth in claim 15 and including the step of crimping a metallic band around said spliced ends of said ignition wire and said electrode wire to secure said spliced ends together.

19. A method of making an ignition probe means as set forth in claim 11 and including the step of disposing said spliced ends of said electrode wire and said ignition wire in side-by-side relation.

20. A method of making an ignition probe means as set forth in claim 19 and including the step of disposing and crimping a splicing band means about said spliced ends of said electrode wire and said ignition wire to secure said spliced ends together.

* * * * *